US005657928A

United States Patent [19]

Jian

[11] Patent Number: 5,657,928

[45] Date of Patent: Aug. 19, 1997

[54] ADJUSTMENT STRUCTURE OF A ROTARY SPRINKLER

[76] Inventor: May-Be Jian, No. 116, Mou-Tan Lane, Chao-An Li, Lu Kang chen, Changhua Hsien, Taiwan

[21] Appl. No.: 553,902

[22] Filed: Nov. 6, 1995

[51] Int. Cl.[6] ..... B05B 3/16

[52] U.S. Cl. ..... 239/242; 239/246; 239/566

[58] Field of Search ..... 239/225.1, 237, 239/240, 242, 246, 247, 273, 548, 550, 551, 556, 562, 582.1, 538, 566

[56] References Cited

U.S. PATENT DOCUMENTS

| | | | |
|---|---|---|---|
| 3,827,637 | 8/1974 | Stephany et al. | 239/242 |
| 3,921,912 | 11/1975 | Hayes | 239/242 |
| 4,860,954 | 8/1989 | Allemann | 239/101 |
| 4,877,185 | 10/1989 | Kufrin | 239/242 |
| 5,052,622 | 10/1991 | Lindermeir et al. | 239/242 |
| 5,305,956 | 4/1994 | Wang | 239/242 |
| 5,350,115 | 9/1994 | Burnworth et al. | 239/242 |
| 5,511,727 | 4/1996 | Heren et al. | 239/242 |

*Primary Examiner*—Andres Kashnikow
*Assistant Examiner*—Lisa Ann Douglas
*Attorney, Agent, or Firm*—Bacon & Thomas

[57] ABSTRACT

An adjustment structure of a rotary sprinkler, including a rotary seat, a plastic rotary tube body, a rubber pad, several adjustment ball valves and a plastic pressing cover. The rotary seat includes a head portion and a tail portion connected therewith. An adjustment member is disposed on the head portion and formed with a fitting hole and a water-incoming head. The tail portion is formed with a fitting hole. The plastic rotary tube body has a close end and an open end. The rotary tube body is formed with an axial channel and several water-outgoing holes are formed on a bottom of the axial channel. The rubber pad is disposed with several concaves. An orifice is disposed on a bottom of each concave. Each adjustment ball valve has a lower ball portion and an upper post portion. An upward tapered sprinkling hole extends from a center of a top face of the post portion to a bottom end of the ball portion. The plastic pressing cover is formed with several through holes on a surface. Each through hole has an inner arch periphery. The adjustment ball valves is easily freely respectively adjustable into different water-outgoing angles or into a sprinkling state or a water-sealed state so as to achieve a variety of sprinkling patterns. The frictional force between the ball valves and the rubber pad and the plastic pressing cover is very small so that the ball valves can be easily adjusted and is not subject to abrasion which will result in leakage.

1 Claim, 5 Drawing Sheets

FIG. I
PRIOR ART 92
90
91
93
90
92
91
3D
3D
3C
3C
82
83
80
81

ADJUSTMENT STRUCTURE OF A ROTARY SPRINKLER

BACKGROUND OF THE INVENTION

The present invention relates to an adjustment structure of a rotary sprinkler, which is easily freely adjustable into different water-outgoing angles or into a sprinkling state or a water-sealed state so as to achieve a variety of sprinkling patterns.

FIG. 1 shows a conventional adjustment structure of a rotary sprinkler, which includes a rotary seat 10, a rotary tube body 20, two adjustment seats 30, a sprinkling seat 40 and two pushing seats 50. The rotary seat 10 includes a head portion 11 and a tail portion 12 connected therewith by two connecting rods 13. An adjustment member 111 is disposed on the head portion 11 and formed with a fitting hole 112 on inner side and a water-incoming head 113 on outer side for connecting with a water pipe. The tail portion 12 is formed with a fitting hole 121 on inner side. The rotary tube body 20 has a closed end 22 and an open end 21. An axial slot 23 is disposed on the Wall of the rotary tube body 20 and extends from the open end 21 to a position in front of the close end 22. Two flanges 231 are formed on two sides of the axial slot 23. Each adjustment seat 30 is formed with two engaging channels 31 on two sides and a dovetail channel 32 on upper face. Several concave rubber sprinkling holes 33 are formed on the bottom of the dovetail channel 32. The sprinkling seat 40 is formed with two engaging channels 41 on two sides and several convex eccentrical sprinkling holes 42. (The right side sprinkling holes 42 sprinkle the water rightward, while the left side sprinkling holes 42 sprinkle the water leftward.) Each pushing seat 50 includes a flat trapezoid base portion 51 and a projection 52 upward projecting from the base portion 51.

FIG. 2 shows the assembly of the adjustment structure of FIG. 1. When assembled, the engaging channels 31 of one of the adjustment seats 30 are engaged with the flanges 231 of the axial slot 23 of the rotary tube body 20 and pushed to an innermost position. Then the base portion 51 of one of the pushing seats 50 is fitted into the dovetail channel 32 of the adjustment seat 30. Then the engaging channels 41 of the sprinkling seat 40 are engaged with the flanges 231 of the axial slot 23 of the rotary tube body 20 and pushed to abut against the edge of the adjustment seat 30. Then the other adjustment seat 30 is similarly engaged with the rotary tube body 20 and pushed to abut against the edge of the sprinkling seat 40. Then the base portion 51 of the other pushing seat 50 is fitted into the dovetail channels 32 of the other adjustment seat 30. Then the close end 22 of the rotary tube body 20 is fitted into the fitting hole 121 of the tail portion 12 of the rotary seat 10, while the open end 21 of the rotary tube body 20 is fitted into the fitting hole 112 of the head portion 11 of the rotary seat 10 to complete the assembly.

Several shortcomings exist in the above structure as follows:

1. When the pushing seat 50 is pushed along the adjustment seat 30 to seal the rubber sprinkling holes 32, the rubber sprinkling holes 32 suffer great torque and frictional force. Therefore, the rubber sprinkling holes 32 are subject to abrasion which will result in leakage of water.

2. The pushing seat 50 cannot effectively seal the eccentrical sprinkling holes 42 of the sprinkling seat 40.

3. The sprinkling holes 33, 42 of the adjustment seats 30 and the sprinkling seat 40 are fixedly oriented so that the sprinkling angle and pattern of the sprinkler are limited.

SUMMARY OF THE INVENTION

It is therefore a primary object of the present invention to provide an adjustment structure of a rotary sprinkler, in which the adjustment ball valves can be easily freely respectively adjusted to different water-outgoing angles so as to achieve a variety of sprinkling patterns.

It is a further object of the present invention to provide the above adjustment structure in which the adjustment ball valves can be freely respectively adjusted into a sprinkling state or a water-sealed state so as to achieve a variety of sprinkling patterns.

It is still a further object of the present invention to provide the above adjustment structure in which the adjustment ball valves can provide an excellent water-sealing effect and the frictional force between the ball valves and the rubber pad and the plastic pressing cover is very small so that the ball valves can be easily adjusted and is not subject to abrasion which will result in leakage.

The present invention can be best understood through the following description and accompanying drawings, wherein:

BRIEF DESCRIPTION OF THE DRAWINGS

FIG. 1A is a sectional view taken along line 1A—1A of FIG. 1;

FIG. 1B is a sectional view taken along line 1B—1B of FIG. 1;

FIG. 1C is a sectional view taken along line 1C—1C of FIG. 1;

FIG. 1D is a sectional view taken along line 1D—1D of FIG. 1;

FIG. 4-1 is a sectional assembled view according to FIG. 4;

DETAILED DESCRIPTION OF THE PREFERRED EMBODIMENT

Figures 3, 3A, 3B, 3C, 3D:
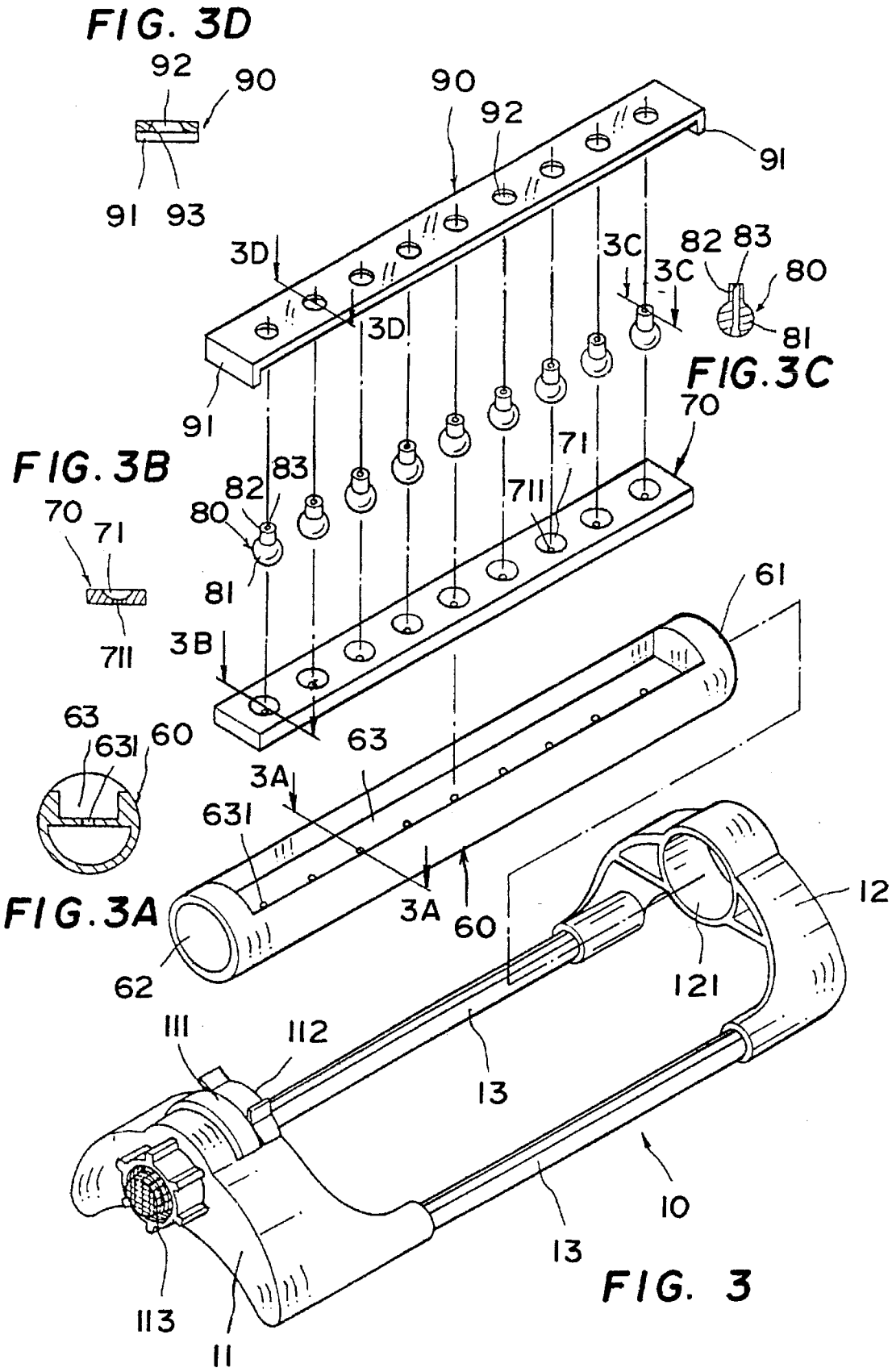
FIG. 3 is a perspective exploded view of the present invention.
FIG. 3A is a sectional view taken along line 3A—3A of FIG. 3.
FIG. 3B is a sectional view taken along line 3B—3B of FIG. 3.
FIG. 3C is a sectional view taken along line 3C—3C of FIG. 3.
FIG. 3D is a sectional view taken along line 3D—3D of FIG. 3.

Please refer to FIG. 3. The present invention includes a rotary seat 10, a plastic rotary tube body 60, a rubber pad 70, several adjustment ball valves 80 and a plastic pressing cover 90. The rotary seat 10 includes a head portion 11 and a tail portion 12 connected with the head portion by two connecting rods 13. An adjustment member 111 is disposed on the head portion 11, formed with a fitting hole 112 on inner side and a water-incoming head 113 on outer side for connecting with a water pipe. The tail portion 12 is formed with a fitting hole 121 on inner side. The plastic rotary tube body 60 has a close end 61 and an open end 62 and is formed with an axial channel 63 on outer wall. Several water-outgoing holes 631 are formed on the bottom of the axial channel 63. The rubber pad 70 is rectangular and disposed with several concaves 71 on upper surface. An orifice 711 is disposed on a center of the bottom of each concave 71. Each adjustment ball valve 80 has a lower ball portion 81 and an upper post portion 82. An upward tapered sprinkling hole 83 extends from a center of the top face of the post portion 82 to the bottom end of the ball portion 81. The plastic pressing cover 90 is formed with two leg portions 91 at two ends and several through holes 92 on the surface. Each through hole 92 has an inner arch periphery 93.

Figure 1:
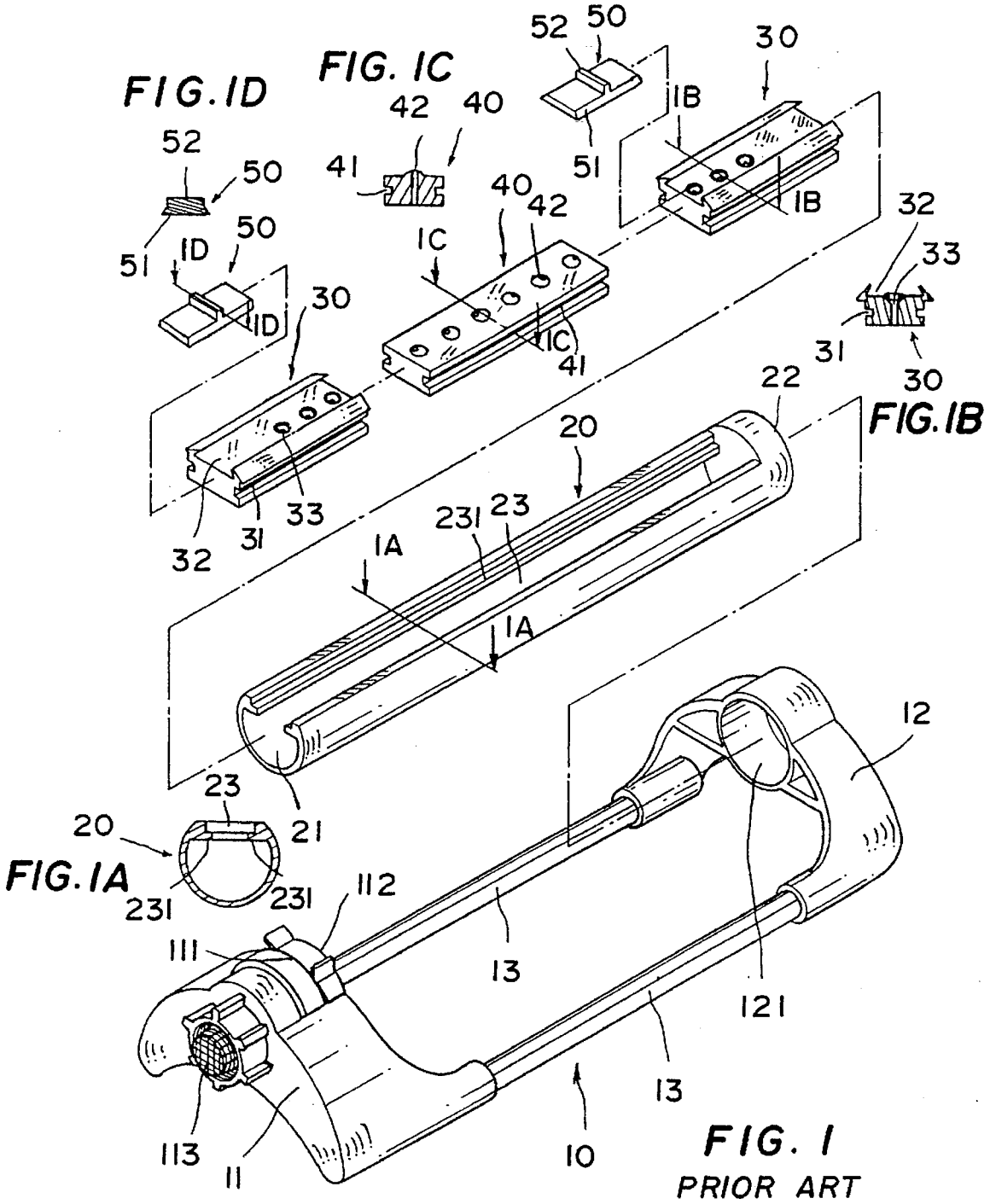
FIG. 1 is a perspective exploded view of a conventional adjustment structure of a rotary sprinkler.
Figure 2:
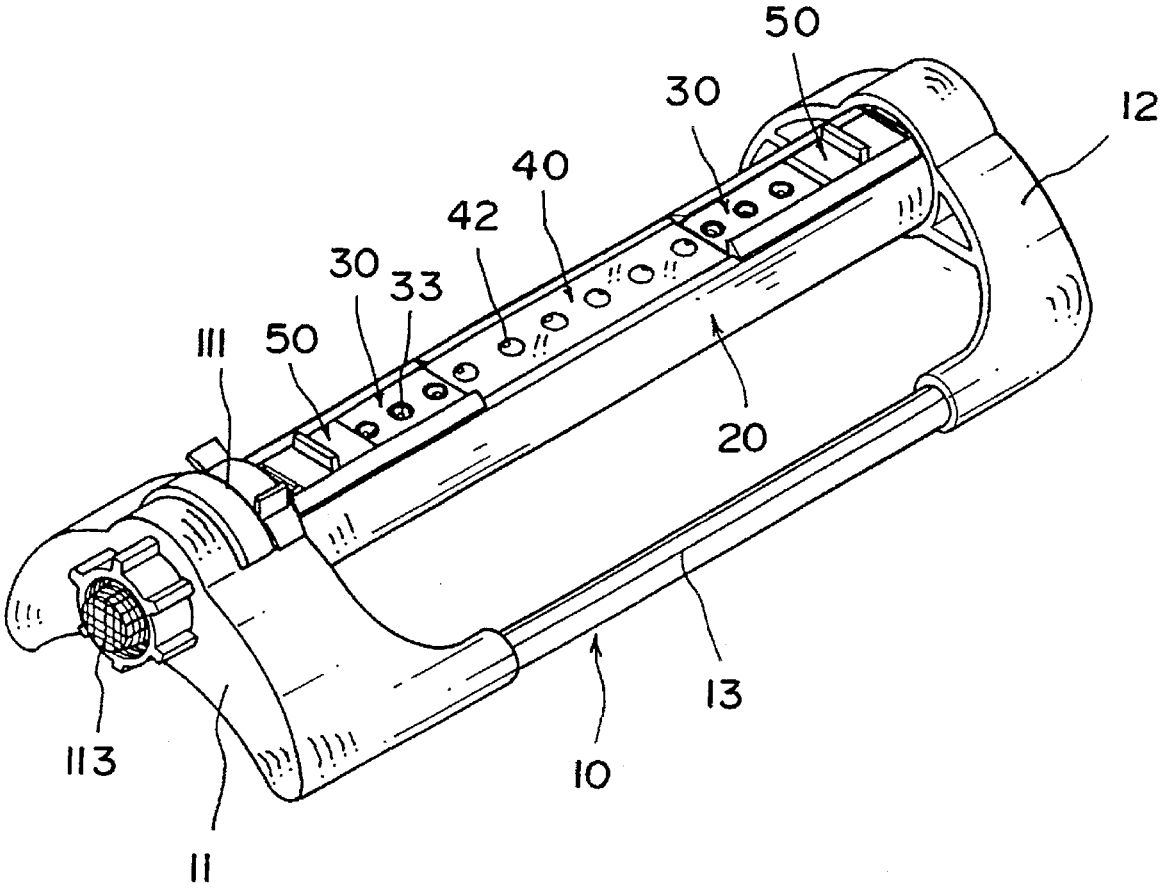
FIG. 2 PRIOR ART
FIG. 2 is a perspective assembled view of the conventional adjustment structure of FIG. 1.
Figure 4:
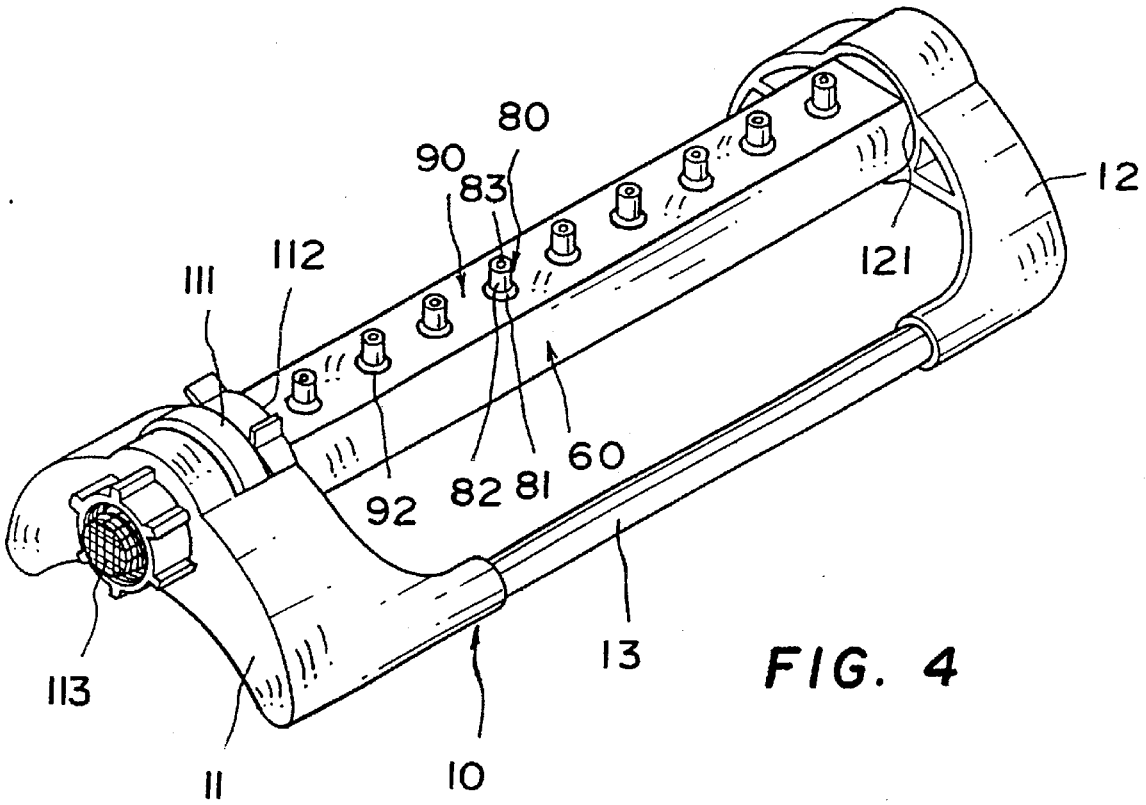
FIG. 4 is a perspective assembled view of the present invention.
Figures 1, 4:
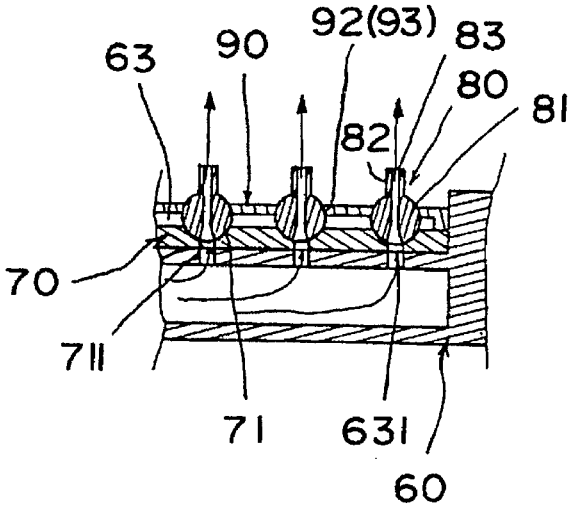

Please refer to FIGS. 4 and 4-1. When assembled, the rubber pad 70 is placed in the axial channel 63 of the rotary tube body 60 with the orifices 711 of the concaves 71 aligned with the water-outgoing holes 631 of the axial channel 63. Then the ball portions 81 of the adjustment ball valves 80 are placed in the concaves 71 of the rubber pad 70 with the post portions 82 faced upward. Then the leg portions 91 of the plastic pressing cover 90 are forcedly inserted into the axial channel 63 of the rotary tube body 60 with the pressing cover 90 overlapped on the rubber pad 70. Also, the post portions 82 of the adjustment ball valves 80 are passed through the through holes 92 of the pressing cover 90 with the inner arch peripheries 93 of the through holes 92 abutting against a one-third section of the ball portions 81, whereby the ball valves 80 can be easily adjusted without being displaced by water flow. Then the leg portions 91 of the pressing cover 90 are fused with two ends of the axial channel 63 of the tube body 60 by high frequency wave. Then the close end of the rotary tube body 60 is fitted into the fitting hole 121 of the tail portion 12 of the rotary seat 10, while the open end 62 of the rotary tube body 60 is fitted into the fitting hole 112 of the head portion 11 of the rotary seat 10 to complete the assembly.

Figure 5:
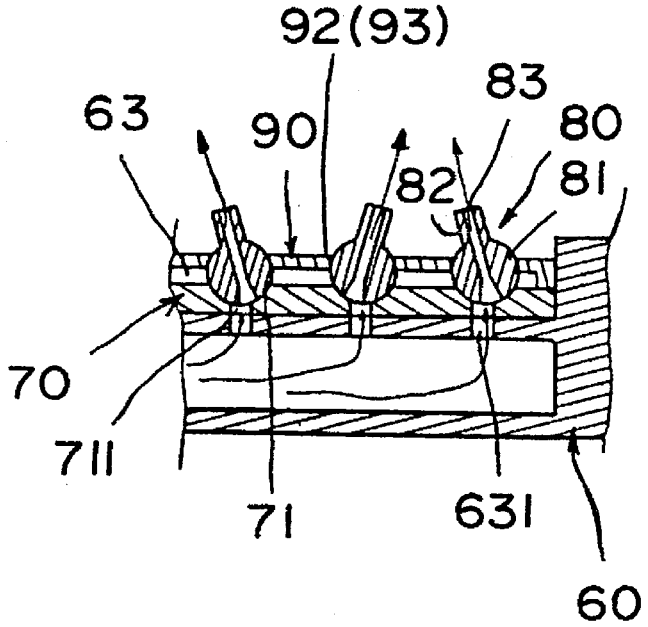
FIG. 5 is a sectional assembled view in which the water-outgoing angle is adjusted by means of rotating the adjustment ball valves.

Please refer to FIG. 5. When it is desired to adjust the water-outgoing angle, the post portions 82 of the adjustment ball valves 80 are directly rotated so that the sprinkling holes 83 thereof are adjusted to a desirable water-outgoing angle. Accordingly, after entering the rotary tube body 60, the water can flow through the water-outgoing holes 631 of the axial channel 63 and the orifices 711 of the concaves 71 of the rubber pad 70 into the bottom ends of the sprinkling holes 83 of the adjustment ball valves 80. Then the water is sprinkled out of the top ends of the sprinkling holes 83 by the adjusted angle to form a variety of sprinkling patterns.

Figure 6:
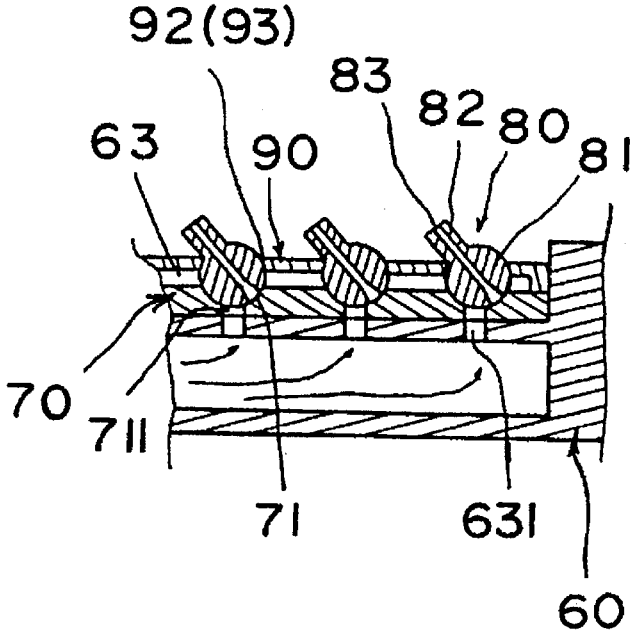
FIG. 6 is a sectional assembled view in which the adjustment ball valves are rotated to a most inclined position so as to shut off the water.

FIG. 6 shows that the post portions 82 of the ball valves 80 are rotated to a most inclined position and the ball portions 81 of the ball valves 80 are rotated through the concaves 71 of the rubber pad 70 and the inner arch peripheries 93 of the through holes 92 of the pressing cover 90 to seal the orifices 711 of the concaves 71. At this time, the sprinkling holes 83 of the ball valves 80 are not communicated with the orifices 711 of the concaves 71 so that the water is prevented from being sprinkled out. Therefore, the adjustment ball valves 80 serve to freely optionally totally or partially shut off the water.

According to the above arrangements, the present invention has the following advantages:

1. The adjustment ball valves can be easily freely respectively adjusted to different water-outgoing angles so as to achieve a variety of sprinkling patterns.

2. The adjustment ball valves can be freely respectively adjusted into a sprinkling state or a water-sealed state so as to achieve a variety of sprinkling patterns.

3. The frictional force between the ball valves and the rubber pad and the plastic pressing cover is very small so that the ball valves can be easily adjusted and is not subject to abrasion which will result in leakage.

The above embodiment is only an example of the present invention and the scope of the present invention should not be limited to the example. Any modification or variation derived from the example should fall within the scope of the present invention.

What is claimed is:

1. An adjustment structure of a rotary sprinkler, comprising a rotary seat, a plastic rotary tube body, a rubber pad, several adjustment ball valves and a plastic pressing cover, wherein the rotary seat includes a head portion and a tail portion connected with the head portion by two connecting rods, an adjustment member being disposed on the head portion and formed with a fitting hole on inner side and a water-incoming, head on outer side for connecting with a water pipe, the tail portion being formed with a fitting hole on inner side, the plastic rotary tube body having a close end and an open end, the close end of the rotary tube body being fitted into the fitting hole of the tail portion of the rotary seat, while the open end of the rotary tube body being fitted into the fitting hole of the head portion of the rotary seat, said adjustment structure being characterized in that:

the rotary tube body is formed with an axial channel on outer wall, several water-outgoing holes being formed on a bottom of the axial channel;

the rubber pad is rectangular and disposed with several concaves on upper surface, an orifice being disposed on a center of a bottom of each concave;

each adjustment ball valve has a lower ball portion and an upper post portion, an upward tapered sprinkling hole extending from a center of a top face of the post portion to a bottom end of the ball portion; and the plastic pressing cover is formed with two leg portions at two ends and several through holes on a surface, each through hole having an inner arch periphery, whereby when assembled, the rubber pad is placed in the axial channel of the rotary tube body with the orifices of the concaves aligned with the water-outgoing holes of the axial channel and then the ball portions of the adjustment ball valves are placed in the concaves of the rubber pad with the post portions faced upward and then the leg portions of the plastic pressing cover are forcedly inserted into the axial channel of the rotary tube body with the pressing cover overlapped on the rubber pad, and the post portions of the adjustment ball valves are passed through the through holes of the pressing cover with the inner arch peripheries of the through holes abutting against a one-third section of the ball portions, and then the leg portions of the pressing cover are fused with two ends of the axial channel of the tube body by high frequency wave, the adjustment ball valves being easily freely respectively adjustable into different water-outgoing angles or into a sprinkling state or a water-sealed state so as to achieve a variety of sprinkling patterns.

* * * * *